US009439456B2

(12) United States Patent
Liu

(10) Patent No.: US 9,439,456 B2
(45) Date of Patent: Sep. 13, 2016

(54) ELECTRONIC CIGARETTE DEVICE, ELECTRONIC CIGARETTE AND ATOMIZING DEVICE THEREOF

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 483 days.

(21) Appl. No.: 13/994,709

(22) PCT Filed: Nov. 12, 2012

(86) PCT No.: PCT/CN2012/084441
§ 371 (c)(1),
(2) Date: Jun. 14, 2013

(87) PCT Pub. No.: WO2014/071623
PCT Pub. Date: May 15, 2014

(65) Prior Publication Data
US 2014/0130816 A1 May 15, 2014

(51) Int. Cl.
*A24F 47/00* (2006.01)

(52) U.S. Cl.
CPC ..... *A24F 47/008* (2013.01)

(58) Field of Classification Search
CPC ..... A24F 47/008; A61L 9/037; A61L 9/127
USPC ..... 392/394–395; 431/320
See application file for complete search history.

(56) References Cited

U.S. PATENT DOCUMENTS 4,621,768 A * 11/1986 Lhoste ..... A61L 9/127 239/44
2003/0005620 A1* 1/2003 Ananth ..... A01M 1/2077 43/125
2011/0303231 A1* 12/2011 Li ..... A24F 47/008 131/329
2013/0081642 A1* 4/2013 Safari ..... A24F 47/008 131/329
2013/0146489 A1* 6/2013 Scatterday ..... A24F 15/20 206/247
2013/0192616 A1* 8/2013 Tucker ..... H01C 17/00 131/328
2013/0213419 A1* 8/2013 Tucker ..... A24F 47/008 131/328

FOREIGN PATENT DOCUMENTS

WO WO 2007078273 A1 * 7/2007 ..... A24F 47/008

* cited by examiner

*Primary Examiner* — Michael H Wilson
*Assistant Examiner* — Eric Yaary
(74) *Attorney, Agent, or Firm* — Cheng-Ju Chiang

(57) ABSTRACT

The present invention relates to an electronic cigarette atomizing device. An atomizer includes an atomizing rod and an electric heating filament wrapped around the atomizing rod, wherein the atomizing rod has a hollow tubular structure made of a non-glass fiber material and a high temperature insulating material. A middle of the atomizing rod is equipped with a liquid guiding rope made of a non-glass fiber material. Multiple liquid guiding holes are radially formed on and penetrate side walls of the atomizing rod in such a manner that a cigarette liquid of the liquid guiding rope is capable of flowing through the liquid guiding holes to the electric heating filament for being atomized. A liquid guiding part of the atomizer is made of a non glass fiber material so as to prevent people from inhaling harmful glass fiber particles.

18 Claims, 7 Drawing Sheets

ELECTRONIC CIGARETTE DEVICE, ELECTRONIC CIGARETTE AND ATOMIZING DEVICE THEREOF

CROSS REFERENCE TO RELATED APPLICATIONS

The present application is a 35 U.S.C. §371 National Phase conversion of International (PCT) Patent Application No. PCT/CN2012/084441, filed on Nov. 12, 2012, the disclosure of which is incorporated by reference herein. The PCT International Patent Application was filed in Chinese.

BACKGROUND OF THE INVENTION

1. Field of the Invention

The present invention relates to an electronic cigarette and a cigarette case, and particularly to an electronic cigarette comprising an atomizing device that has an atomizing rod made of non-glass fiber, and an electronic cigarette device thereof.

2. Related Art

A current electronic cigarette has an inhaling rod and a power rod. The inhaling rod generally includes a suction nozzle and an atomizer for converting cigarette liquid to smoke. The power rod is generally installed with a battery and a control switch, the battery is used for providing power, and the control switch is used to control the operation of the electronic cigarette.

An atomizing rod of the atomizer of a current electronic cigarette is generally made of a glass fiber material for allowing electric heating wires to be wrapped around and for providing a cigarette liquid to the electric heating wires for being heated to generate smoke. When using the electronic cigarette, glass fiber particles will be generated at the time that the electric heating wires are heated and will be inhaled together with smoke by people, whereby causing damage to people.

SUMMARY OF THE INVENTION

An object of the present invention is to provide an electronic cigarette atomizing device comprising an atomizing rod made of a non-glass fiber material and a liquid guiding rope so as to prevent harmful glass fiber particles to people from being generated.

To achieve the above object, the present invention discloses an electronic cigarette atomizing device, comprising an atomizing cup and an atomizer disposed in the atomizing cup. The atomizer comprises an atomizing rod and an electric heating filament wrapped around the atomizing rod, wherein the atomizing rod has a hollow tubular structure which is made of a non-glass fiber material and a high temperature insulating material. A middle of the atomizing rod is passed through with a liquid guiding rope made of a non-glass fiber material, and multiple liquid guiding holes are radially formed on and penetrate side walls of the atomizing rod in such a manner that a cigarette liquid of the liquid guiding rope is capable of flowing through the liquid guiding holes to the electric heating filament for being atomized and converted to smoke.

According to one aspect of this invention, the non-glass fiber material of the liquid guiding rope is selected from one of high temperature cotton, chemical fiber cotton, mixture cotton, pure cotton, and non-woven cotton.

According to another aspect of this invention, the liquid guiding holes are arranged in array alignment around the atomizing rod in an axial direction thereof.

According to another aspect of this invention, the liquid guiding holes are disposed in a radial direction of the atomizing rod in annular arrangement about an axle center of the atomizing rod.

According to another aspect of this invention, the atomizing rod has a round shape, a polygonal shape, or a petal shape in cross section.

According to another aspect of this invention, wherein each of the liquid guiding holes has an oval shape, a polygonal shape, or a straight line shape in cross section.

According to another aspect of this invention, the atomizing cup comprises a liquid storing portion and a support element mounted in the liquid storing portion, the support element has a hollow tubular structure, and a middle of the support element forms an atomizing chamber for receiving the atomizer.

According to another aspect of this invention, the atomizer is transversally disposed in the atomizing cup, and two ends of the liquid guiding rope are respectively connected to the liquid storing portion.

According to another aspect of this invention, engaging holes are radially formed on and penetrate side walls of the support element for being engaged with the atomizing rod.

According to another aspect of this invention, the atomizer is axially disposed in the atomizing cup, and two ends of the liquid guiding rope are respectively connected to the liquid storing portion.

Another object of the present invention is to provide an electronic cigarette, comprising an atomizing device including an atomizing rod and a liquid guiding rope being made of a non-glass fiber material so as to prevent people from being harmed by inhaling glass fiber particles.

To achieve the above object, the present invention discloses an electronic cigarette comprising a main rod body, one end of the main rod body being provided with a suction nozzle, another end thereof being installed with a battery, and an atomizing device disposed in the main rod body adjacent to the suction nozzle and electrically connected with the battery.

According to another aspect of this invention, one end of the atomizing device adjacent to the battery is installed with a connecting module for electrically connecting the atomizing device and the battery, the connecting module comprises a first electrode element designated as a first electrode of the atomizing device, and a second electrode element designated as a second electrode of the atomizing device, and the first and second electrode elements are engaged with each other through a insulating ring.

According to another aspect of this invention, two ends of the electric heating filament are electrically connected to the first and second electrode elements.

According to another aspect of this invention, the electronic cigarette further comprises a control system electrically connecting with the battery for controlling power on or off of the atomizing device, and the control system is capable of being installed between the atomizing device and the battery, or installed at one end of the battery far away from the atomizing device.

Still, another object of the present invention is to provide an electronic cigarette device being stored with at least one electronic cigarette which does not produce glass fiber particles that are harmful to people and flowed together with smoke into human bodies.

To achieve the above object, the electronic cigarette device comprises an electronic cigarette case and at least one electronic cigarette accommodated in the electronic cigarette case. The at least one electronic cigarette is the electronic cigarette as described above.

The advantages of the present invention are as follows: because the atomizing rod is made of a non-glass fiber material and a high temperature insulating material, and the atomizing rod is passed through with the liquid guiding rope made of a non-glass fiber material, the electric heating filament is capable of being heated without generating glass fiber particles, whereby enabling a more safe and healthy use.

Embodiments of the present invention are further described below in detail in conjunction with accompanying drawings.

DESCRIPTION OF THE PREFERRED EMBODIMENTS

As shown in FIG. 1 to FIG. 11, the present invention is to provide an electronic cigarette device, comprising a plurality of electronic cigarettes 100 and an electronic cigarette case 200 for storing the electronic cigarettes 100.

Figure 8:
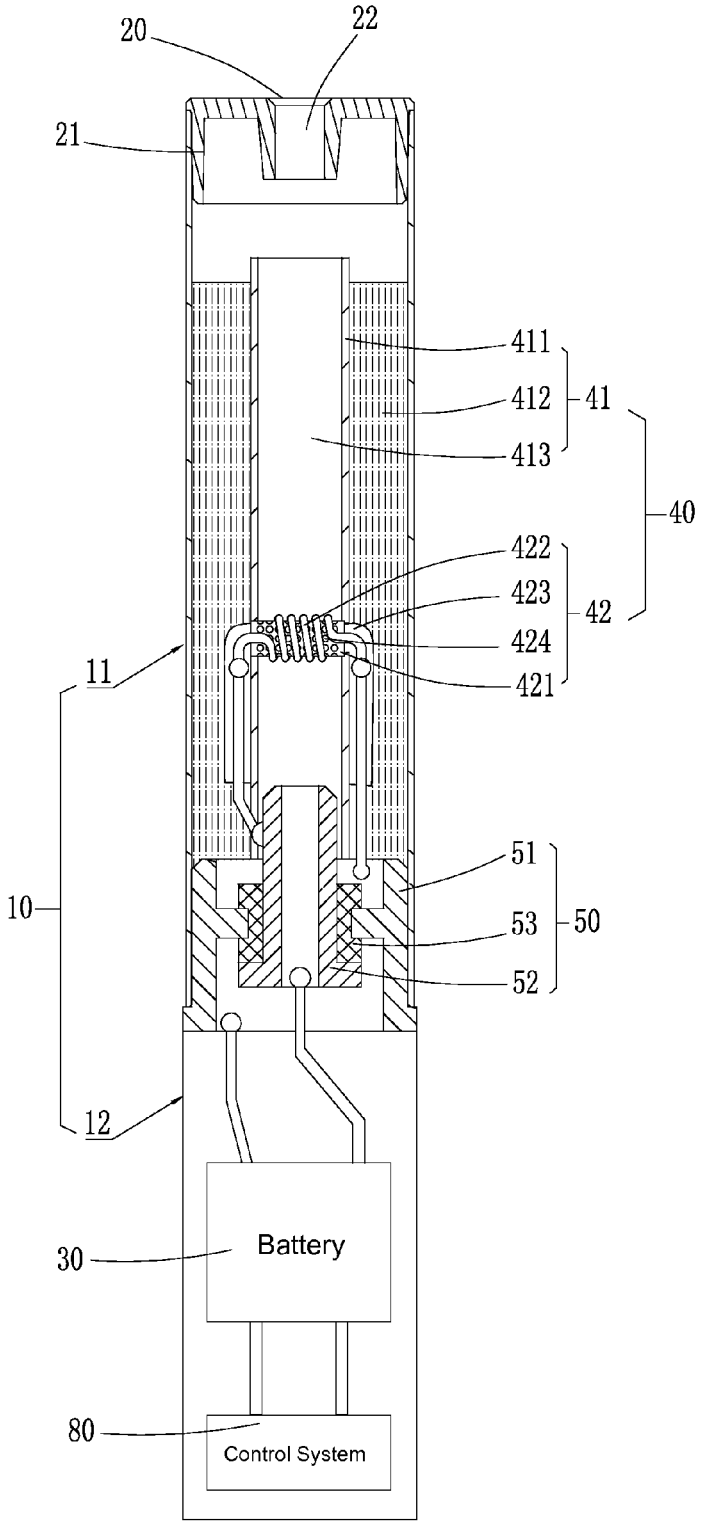
FIG. 8 is a schematic structural view of an electronic cigarette of a first embodiment in accordance with the present invention.
Figure 9:
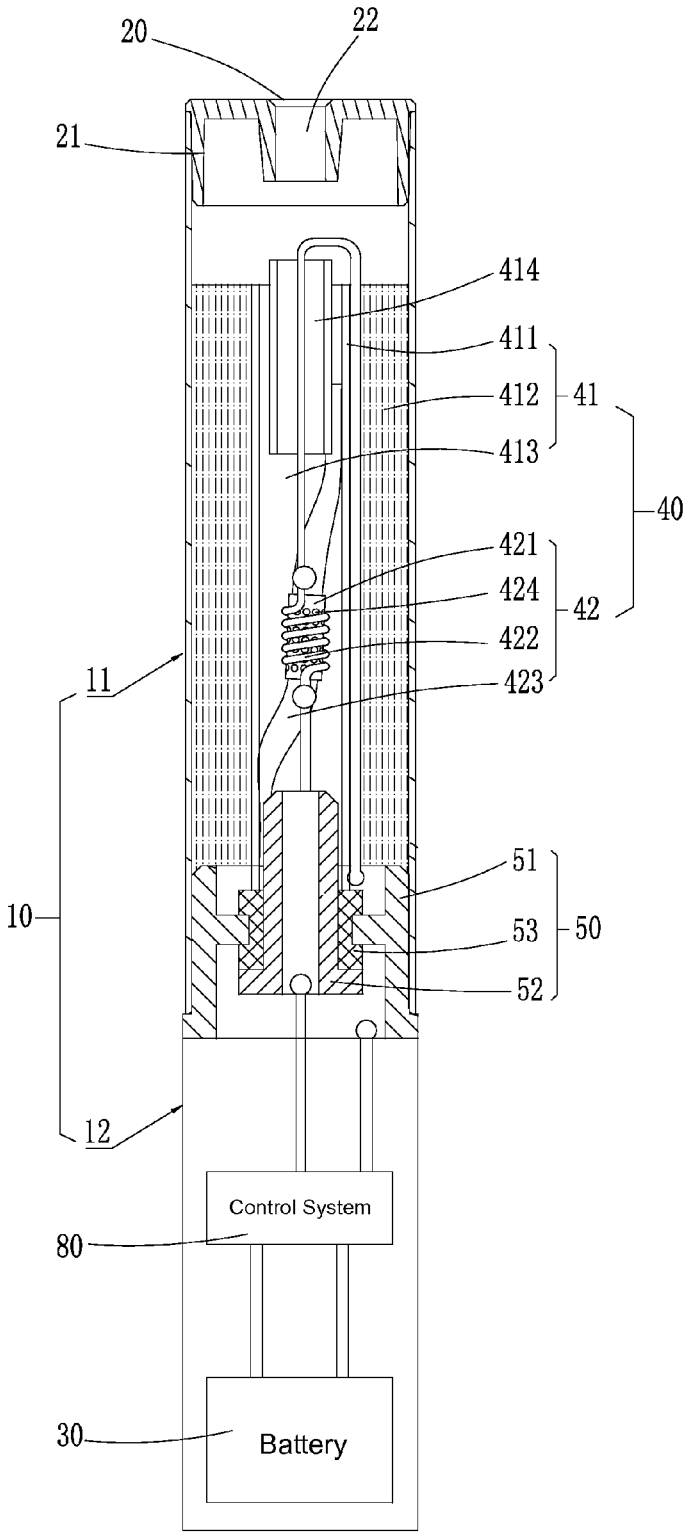
FIG. 9 is a schematic structural view of an electronic cigarette of a second embodiment in accordance with the present invention.
Figure 10:
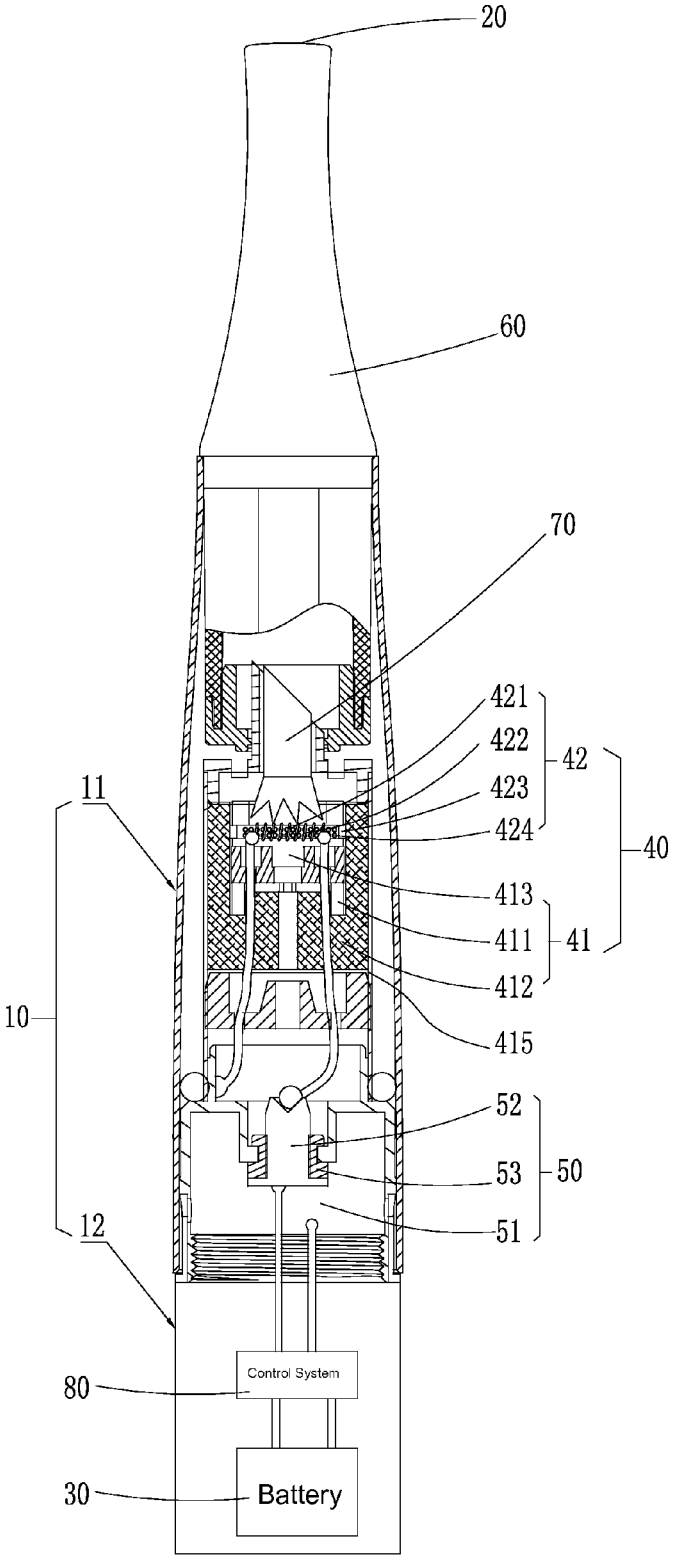
FIG. 10 is a schematic structural view of an electronic cigarette of a third embodiment in accordance with the present invention.

As shown in FIG. 8 to FIG. 10, each of the electronic cigarettes 100 comprises a main rod body 10. The main rod body 10 has a cylindrical tubular structure being hollow therein to form an accommodating chamber for each internal component. It is understandable that the main rod body 10 is not limited by a cylindrical shape as shown in the present embodiment, and can be any other tubular structure having a hollow chamber. In this embodiment, the main rod body 10 is made of a stainless steel material, a plastic material, or other suitable materials.

One end of the main rod body 10 is provided with a suction nozzle 20, another end far away from the suction nozzle 20 is installed with a battery 30. Therefore, according to internal components of the main rod body 10 and functions thereof, the main rod body 10 is capable of being separated into two parts including an inhaling rod 11 and a power rod 12. That is, the main rod body 10 consists of the inhaling rod 11 and the power rod 12 interconnecting with each other. In this embodiment, the inhaling rod 11 and the power rod 12 are designed to be inseparable as a one-piece structure. In another aspect, the inhaling rod 11 and the power rod 12 are detachably connected in a manner of, such as, engaging connection, inserting connection or screwing connection.

The battery 30 is installed in the power rod 12 for providing power for each functional module. The suction nozzle 20 is mounted onto one end of the inhaling rod 11 far away from the battery 30. In this embodiment, the suction nozzle 20 and the main rod body 10 are detachably connected. The suction nozzle 20 comprises a nozzle cap 21 mounted onto the end of the inhaling rod 11, and the nozzle cap 21 is axially formed with a suction hole 22. In one aspect, the suction nozzle 22 and the main rod body 10 are formed integrally.

Please continuously refer to FIG. 8 to FIG. 10. The main rod body 10 is installed with an atomizing device 40 for atomizing a cigarette liquid and converting it to smoke. The atomizing device 40 is disposed in the inhaling rod 11 of the main rod body 10 between the suction nozzle 20 and the battery 30. The atomizing device 40 comprises an atomizing cup 41 and an atomizer 42 securely disposed in the atomizing cup 41.

The atomizing cup 41 comprises a support element 41 and a liquid storing portion 412 mounted onto the outside of the support element 411.

The liquid storing portion 412 has a hollow tubular structure capable of absorbing and storing liquid as a sponge, and is intended to absorb and store the cigarette liquid which is then atomized by the atomizer 42. In this embodiment, the liquid storing portion 412 is made of glass fiber, absorbent cotton, nickel foam or other materials capable of absorbing and storing liquid.

The support element 411 also has a hollow tubular structure and is mounted in the liquid storing portion 412 where outer walls of the support element 411 are in snug engagement with inner walls of the liquid storing portion 412 so as to secure the liquid storing portion 412 in the main rod body 10. A middle of the hollow structure support element 411 forms a communicating air channel of the atomizing device 40 as well as an atomizing chamber 413 for receiving the atomizer 42.

The atomizer 42 is intended to atomize and convert the cigarette liquid to smoke, and comprises an atomizing rod 421 and an electric heating filament 422. The electric heating filament 422 is wrapped around the atomizing rod 421 and is therefore disposed in the atomizing cup 41.

Figure 1:
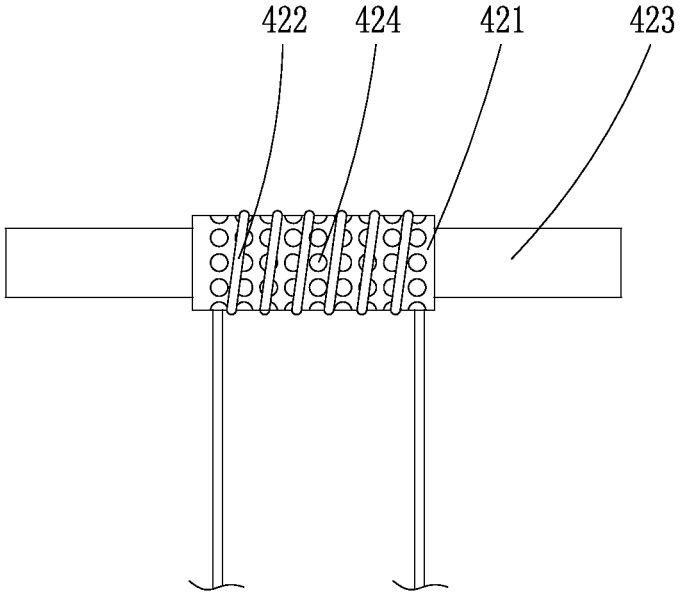
FIG. 1 is a schematic structural view of an electronic cigarette atomizing device in accordance with an embodiment of the present invention.

Referring to FIG. 1, the atomizing rod 421 has a hollow tubular structure and a middle thereof is passed through with a liquid guiding rope 423. Multiple liquid guiding holes 424 are radially formed on side walls of the atomizing rod 421. In this embodiment, the atomizing rod 421 is made of a non-fiber glass material and a high temperature insulating material, such as aluminum processed with oxidation treatment or other various insulating metallic materials that are high temperature resistant, or other non-metallic materials that are high temperature resistant such as, for example, ceramic materials.

Figure 5:
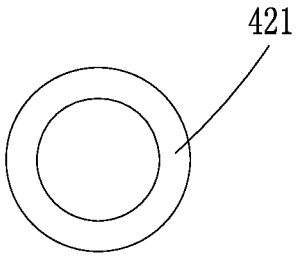
FIG. 5 is a schematic view showing a first embodiment of a bottom of the atomizing rod in a radial direction in accordance with the present invention.
Figure 6:
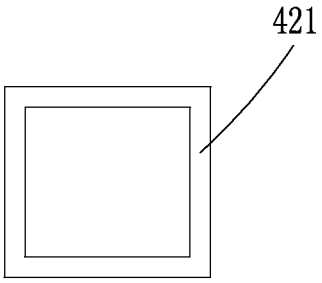
FIG. 6 is a schematic view showing a second embodiment of a bottom of the atomizing rod in the radial direction in accordance with the present invention.
Figure 7:
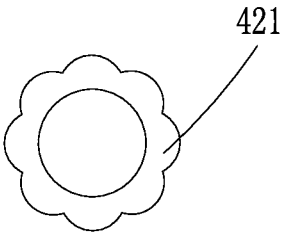
FIG. 7 is a schematic view showing a third embodiment of a bottom of the atomizing rod in the radial direction in accordance with the present invention.

As shown in FIG. 5 to FIG. 7, in this embodiment, the hollow tubular structure of the atomizing rod 421 has a round shape, a polygonal shape, or a petal shape in cross section, and outer contours of the atomizing rod 421 may be different than or same as inner contours of the hollow structure.

Figure 2:
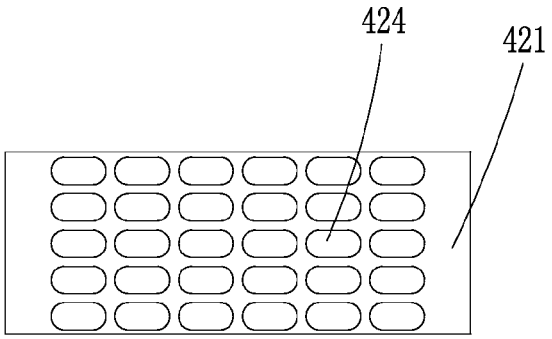
FIG. 2 is a schematic view showing a first embodiment of a side of an atomizing rod in an axial direction thereof in accordance with the present invention.
Figure 3:
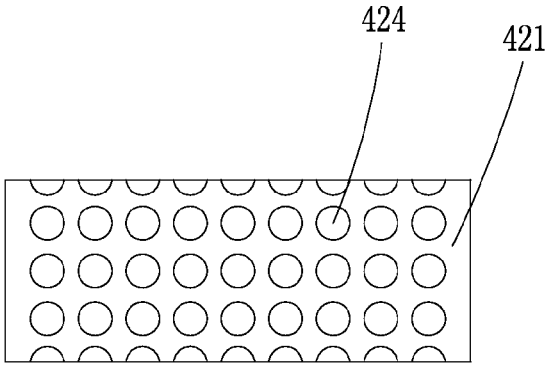
FIG. 3 is a schematic view showing a second embodiment of a side of the atomizing rod in the axial direction in accordance with the present invention.
Figure 4:
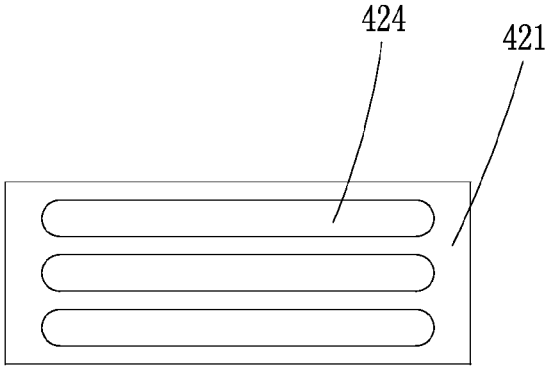
FIG. 4 is a schematic view showing a third embodiment of a side of the atomizing rod in the axial direction in accordance with the present invention.

The liquid guiding holes 424 are radially formed on and penetrate side walls of the atomizing rod 421, and are intended to enable the cigarette liquid of the liquid guiding rope 423 to flow through the liquid guiding holes 424 to the electric heating filament 422 for being atomized and converted to smoke. As shown in FIG. 2 to FIG. 4, in this embodiment, each of the liquid guiding holes 424 has an oval shape, a polygonal shape, or a straight line shape in cross section.

In order for the liquid guiding holes 424 throughout the atomizing rod 421 are filled with even and sufficient guiding liquid, the liquid guiding holes 424 are disposed in a radial direction of the atomizing rod 421 in annular arrangement about an axle center of the atomizing rod 421, and are concurrently arranged in array alignment around the atomizing rod 421 in an axial direction thereof.

The liquid guiding rope 423 is intended to absorb the cigarette liquid in such a manner that the cigarette liquid permeates into the electric heating filament 422 and is atomized by the electric heating filament 422 to become smoke. Two ends of the liquid guiding rope 423 pass through the atomizing rod 421 and are respectively connected to the liquid storing portion 412 so as to enable the cigarette liquid to permeate into the liquid guiding rope 423 from the liquid storing portion 412. In this embodiment, the liquid guiding rope 423 is made of one of high resistant cotton, chemical fiber cotton, mixture cotton, pure cotton, and non-woven cotton, or other non-glass fiber material featuring relatively high absorbing quality, and has a rope-like shape or a pillar-like shape.

Referring to FIG. 8 to FIG. 10, one end of the atomizing device 40 adjacent to the battery 30 is installed with a connecting module 50 for electrically connecting the atomizing device 40 and the battery 30. The connecting module 50 and the suction nozzle 20 are respectively mounted to two ends of the inhaling rod 11 so as to seal the atomizing device 40 in the inhaling rod 11.

In this embodiment, the connecting module 50 comprises a first electrode element 51 designated as a first electrode of the atomizing device 40, and a second electrode element 52 designated as a second electrode of the atomizing device 40, and the first and second electrode elements 51 and 52 are coupled with each other through an insulating ring 53.

The first electrode element 51 has a hollow tubular structure and is snugly mounted to one end of the inhaling rod 11 far away from the suction nozzle 20 and is engaged with the atomizing device 40, a middle of the first electrode element 51 extending radially inwards to form a rib for mounting the second electrode element 52.

The second electrode element 52 is configured to match the first electrode element 51 and is engaged with and insulated from the first electrode element 51 through the insulating ring 53. In this embodiment, the second electrode element 52 also has a hollow tubular structure being centered therein and forming an air inlet hole to allow outside air to flow in the atomizing device 40.

In this embodiment, the first electrode element 51 is designated as a cathode of the atomizing device 40 and is coupled with a cathode of the battery 30. The second electrode element 52 is designated as an anode of the atomizing device 40 and is coupled with an anode of the battery 30. Two ends of the electric heating filament 422 are respectively electrically connected to the first electrode element 51 and the second electrode element 52 through welding, riveting, engaging and other fixing manners.

Continuously referring to FIG. 8 to FIG. 10, the atomizer 42 is capable of being disposed in the atomizing cup 41 in various ways according to configuration of the electronic cigarette 100.

As an embodiment shown in FIG. 8, the atomizing rod 421 is transversally disposed in the atomizing cup 41, and two ends of the liquid guiding rope 423 are respectively connected to the liquid storing portion 412.

Specifically, in this embodiment, the suction nozzle 20 and the connecting module 50 are respectively mounted to two ends of the inhaling rod 11. The atomizing device 40 is disposed in the haling rod 11 through the connecting module 50. The first electrode element 51 is connected to bottoms of the liquid storing portion 412 and the support element 411. An end surface of the second electrode element 52 adjacent to the suction nozzle 20 is higher than an end surface of the first electrode element 51 adjacent to the suction nozzle 20 with an appropriate height and therefore functions as a positioning pillar for the support element 411. In practice, the end surface of the first electrode element 51 adjacent to the suction nozzle 20 is much more lower than an end surface of the support element 411 adjacent to the suction nozzle 20, whereby ensuring that the atomizing chamber 413 provides an adequate space for the electric heating filament 422 to operate therein.

In this embodiment, the support element 411 is made of a ceramic material, and outer walls thereof are snug against inner walls of the liquid storing portion 412. The support element 411 functions as a support frame for the liquid storing portion 412 so as to snug the liquid storing portion 412 in the main rod body 10. Engaging holes are radially formed on and penetrate side walls of the support element 411. Two ends of the atomizing rod 421 are respectively engaged with the engaging holes so as to realize a transversal positioning of the atomizing rod 421. The two ends of the liquid guiding rope 423 pass through the support element 411 from the engaging holes to abut against the inner walls of the liquid storing portion 412 so as to absorb the cigarette liquid of the liquid storing portion 412 for the electric heating filament 422 to heat and atomize.

The electric heating filament 422 is wrapped around the atomizing rod 421 and passes through the support element 411 from the engaging holes along with the liquid guiding rope 423 to reach the liquid storing portion 412. The liquid storing portion 412 is correspondingly formed with threading holes for the electric heating filament 422 to pass through. The two ends of the electric heating filament 422 respectively pass through the threading holes to electrically connect the first and second electrode elements 51 and 52.

Referring to FIG. 9, an embodiment as shown in FIG. 9, the atomizing rod 41 is axially disposed in the atomizing cup 41, and the two ends of the liquid guiding rope 423 are respectively connected to the liquid storing portion 412.

Specifically, in this embodiment, the suction nozzle 20 and the connecting module 50 are respectively mounted to the two ends of the inhaling rod 11. The atomizing device 40 is disposed in the haling rod 11 through the connecting module 50. The first electrode element 51 is connected to the bottoms of the liquid storing portion 412 and the support element 411. An end surface of the second electrode element 52 adjacent to the suction nozzle 20 is higher than an end surface of the first electrode element 51 adjacent to the suction nozzle 20 with an appropriate height and therefore functions as a positioning pillar for the support element 411. In practice, the end surface of the first electrode element 51 adjacent to the suction nozzle 20 is much more lower than an end surface of the support element 411 adjacent to the suction nozzle 20, whereby ensuring that the atomizing chamber 413 provides an adequate space for the electric heating filament 422 to operate therein.

In this embodiment, the support element 411 is made of high temperature cotton or chemical fiber cotton or other materials that are capable of absorbing and storing liquid. The support element 411 is snug against the inner walls of the liquid storing portion 412 so as to absorb the cigarette liquid of the liquid storing portion 412, wherein the snug engagement between the outer walls of the support element 411 and the inner walls of the liquid storing portion 412 functions as a support frame for the liquid storing portion 412 in order to snugly secure the liquid storing portion 412 in the main rod body 10.

In this embodiment, the liquid guiding rope 423 does not directly abut against the liquid storing portion 412, wherein one end of the liquid guiding rope 423 adjacent to the suction nozzle 20 is through a hollow ceramic tube 414 snugly secured in an upper portion of the support element 411, and another end of the liquid guiding rope 423 snugly secured in a lower portion of the support element 411 over the second electrode element 52 so as to axially position the atomizing rod 421.

Because in this embodiment the support element 411 is made of high temperature cotton or chemical fiber cotton or other materials that are high temperature-resistant and great permeation, the liquid guiding rope 423 is capable of abutting against the support element 411 rather than directly contact the liquid storing portion 412. The support element 411 functions as a cigarette liquid permeating portion of the atomizing device 40 in order to enable the cigarette liquid of the liquid storing portion 412 to be permeated to the support element 411 and to be absorbed by the liquid guiding rope 423. With the above-mentioned structure, the electronic cigarette 100 is improved in cigarette liquid guiding effect and is more convenient and quick to be assembled.

In this embodiment, the electric heating filament 422 is wrapped around the atomizing rod 421, wherein one end of the electric heating filament 422 adjacent to the suction nozzle 20 is bent to be securely clamped between the support element 411 ant the liquid storing element 412 and is terminated by electrically connecting the first electrode element 51, and another end thereof away from the suction nozzle 20 is directly electrically connected to the second electrode element 52.

It is understandable that when the support element 411 as the embodiment shown in FIG. 8 is made of a ceramic material rather than a material capable of absorbing liquid and storing liquid as the embodiment shown in FIG. 9, the atomizing rod 421 is also allowed to be axially disposed in the atomizing cup 41. In specific, two ends of the support element 411 are respectively formed with the engaging holes for the liquid guiding rope 423 to pass therethrough to engage with the liquid storing portion 412 so as to ensure that the liquid guiding rope 423 can normally absorb the cigarette liquid, or the two ends of the liquid guiding rope 423 are respectively bent and engaged with upper and lower portions of the support element 411 and the liquid storing portion 412, whereby to realize an axial positioning of the atomizing rod 421 as well.

Referring to FIG. 10, as an embodiment shown in FIG. 10, the atomizing rod 421 is transversally disposed in the atomizing cup 41, and two ends of the liquid guiding rope 423 are respectively connected to the liquid storing portion 412.

In the embodiment, the inhaling rod 11 is exposed to outside and has a tubular structure tapering at a predetermined tapering angle such that a diameter of the inhaling rod 11 is increasingly reduced towards one end of the suction nozzle 20. The suction nozzle 20 and the connecting module 50 are respectively mounted to two ends of the inhaling rod 11. The atomizing device 40 is disposed in the haling rod 11 through the connecting module 50. A cigarette liquid cup 60 is provided between the suction nozzle 20 and the atomizing device 40. A liquid guiding unit 70 is installed between the cigarette liquid cup 60 and the atomizing device 40 for guiding the cigarette liquid to the liquid storing portion 412.

In this embodiment, the liquid storing portion 412 has a hollow tubular structure, a middle in a bottom of the liquid storing portion 412 extends toward a top end thereof to for a positioning pillar having an appropriate height, wherein a hollow channel is formed in and penetrates a middle hollow portion of the liquid storing portion 412, and an accommodating chamber is defined on an upper end of the liquid storing portion 412 for accommodating the support element 411. The support element 411 utilizes inner walls thereof to be mounted to the positioning pillar of the liquid storing portion 412, and concurrently utilizes outer walls thereof to be snug against inner walls of the liquid storing portion 412.

Engaging holes are radially formed on and penetrate side walls of the supporting element 411. The two ends of the atomizing rod 421 are respectively engaged with the engaging holes. The two ends of the liquid guiding rope 423 pass through the support element 411 from the engaging holes to abut against the inner walls of the liquid storing portion 412 so as to absorb the cigarette liquid of the liquid storing portion 412 for the electric heating filament 422 to heat and atomize.

The electric heating filament 422 is wrapped around the atomizing rod 421, and two ends of the electric heating filament 422 respectively pass through threading holes correspondingly formed on the liquid storing portion 412 to electrically connect the first and second electrode elements 51 and 52.

In this embodiment, the atomizing cup 41 comprises an individual cup body 415 by which the liquid storing portion 412 is not in a direct contact with inner walls of the maid rod body 10. A middle of the first electrode element 51 extends upward to form a protruding rim corresponding to the cup body 415 so as to securely snug the cup body 415 against the inner walls of the main rod body 10.

Continuously referring to FIG. 8 to FIG. 10, a control system 80 is configured at one end of the maid rod body 10 far away from the suction nozzle 20 and electrically connected to the battery 30 for controlling power on or off of the atomizing device 40. The controlling system 80 comprises an atomizing control circuit and an atomizing control switch coupled with the atomizing control circuit. The control system 80 is capable of being disposed between the battery 30 and the atomizing device 40, or disposed at one end of the battery 30 far away from the atomizing device 40.

In this embodiment, the atomizing control switch is exemplified by a transducer switch. Specifically, the transducer switch is a capacitive transducer switch. When a user uses the electronic cigarette 100 for smoking, the capacitive transducer switch senses an inhaling air flow, capacitors thereof are changed accordingly so as to control the atomizing control circuit to connect electric power, and therefore the electronic cigarette 100 is in an operating state. As one aspect, the transducer switch is alternatively exemplified by an air-flow transducer switch, that is, when a user is inhaling from the suction nozzle 20, a negative pressure is generated in the electronic cigarette 100 and causes the air-flow transducer switch to generate a pulse signal so as to control the atomizing control circuit to connect electric power.

For the transducer switch is relatively precision in manufacture, a specific controller is generally installed therein. Accordingly, the atomizing control circuit of this embodiment is directly integrated in the controller of the transducer switch. As one aspect, the atomizing control circuit is capable of being integrated on an atomizing control circuit board which is disposed away from the transducer switch and is coupled with the transducer switch and the battery 30.

Certainly, as one aspect, the atomizing control switch is capable of exemplified by a traditional key switch or touch-type switch.

It is understandable that the electronic cigarette 100 of the present invention is not limited by the above-mentioned three embodiments as shown in FIG. 8 to FIG. 10, each technical feature disclosed in each of the embodiments may be combined with each other to create a new embodiment.

Figure 11:
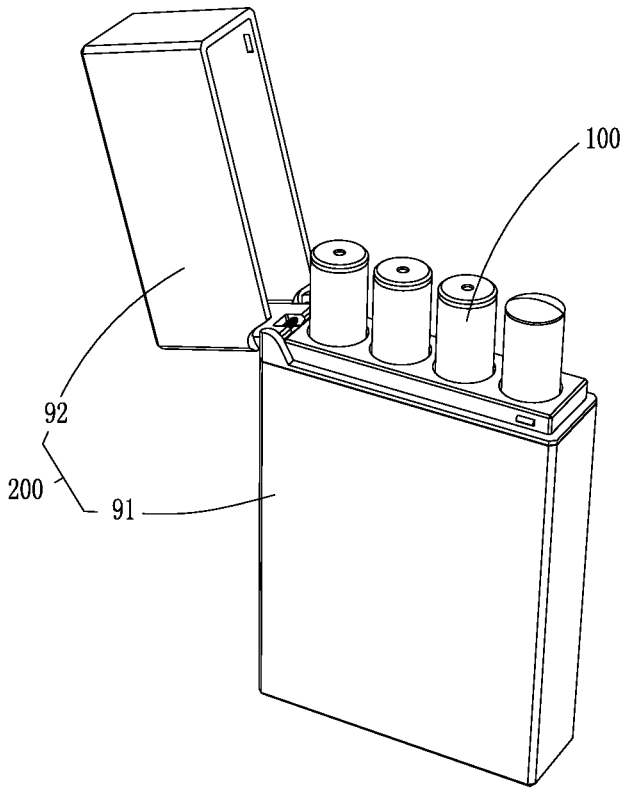
FIG. 11 is a perspective view of an electronic cigarette device of the present invention.

As shown in FIG. 11, the plurality of electronic cigarettes 100 are generally placed in the electronic cigarette case 200. The electronic cigarette case 200 comprises a bottom case 91 for storing the plurality of electronic cigarettes 100, and a case cover 92 for covering on the bottom case 91. The bottom case 91 has a rectangular case structure; certainly, a shape of the bottom case 91 is not limited by being rectangular, and can be round, oval, or polygonal, etc, as long as the case cover 92 matches the bottom case 91.

It is understood that the invention may be embodied in other forms within the scope of the claims. Thus the present examples and embodiments are to be considered in all respects as illustrative, and not restrictive, of the invention defined by the claims.

What is claimed is:

1. An electronic cigarette atomizing device, comprising an atomizing cup and an atomizer disposed in the atomizing cup, the atomizer comprising an atomizing rod and an electric heating filament wrapped around the atomizing rod, wherein the atomizing rod has a hollow tubular structure which is made of a material that is not glass fiber but high-temperature resistant and insulating material, a middle of the atomizing rod is passed through with a liquid guiding rope made of a material that is not glass fiber, and multiple liquid guiding holes are radially formed on and penetrate side walls of the atomizing rod in such a manner that a cigarette liquid of the liquid guiding rope is capable of flowing through the liquid guiding holes to the electric heating filament for being atomized and converted to smoke;

the atomizing cup comprises a liquid storing portion and a support element mounted in the liquid storing portion, the support element has a hollow tubular structure, and a middle of the hollow support element forms a communicating air channel of the atomizing device as well as an atomizing chamber for receiving the atomizer;

the liquid storing portion has a hollow tubular structure capable of absorbing and storing liquid as a sponge, and is intended to absorb and store the cigarette liquid which is then atomized by the atomizer;

the atomizing device is disposed in an inhaling rod of the electronic cigarette; and a connecting module and a suction nozzle are respectively mounted to two ends of the inhaling rod for sealing the liquid storing portion in the inhaling rod;

two ends of the liquid guiding rope pass through the atomizing rod and are intended to absorb the cigarette liquid in such a manner that the cigarette liquid permeates into the electric heating filament and is atomized by the electric heating filament to become smoke;

the liquid guiding rope does not directly abut against the liquid storing portion; a hollow ceramic tube is fitted in an upper end of the support element one end of the liquid guiding rope is snugly secured between the hollow ceramic tube and the support element, and another end of the liquid guiding rope snugly secured in a lower portion of the support element by the connecting module so as to axially position the atomizing rod.

2. The electronic cigarette atomizing device of claim 1, wherein the material of the liquid guiding rope is selected from one of heat-resistant cotton, chemical fiber cotton, mixture cotton, pure cotton, and non-woven cotton.

3. The electronic cigarette atomizing device of claim 1, wherein the liquid guiding holes are arranged in array alignment around the atomizing rod in an axial direction thereof.

4. The electronic cigarette atomizing device of claim 1, wherein the liquid guiding holes are disposed in a radial direction of the atomizing rod and in annular arrangement about an axle center of the atomizing rod.

5. The electronic cigarette atomizing device of claim 1, wherein the atomizing rod has a round shape, a polygonal shape, or a petal shape in cross section.

6. The electronic cigarette atomizing device of claim 1, wherein each of the liquid guiding holes has an oval shape, a polygonal shape, or a straight line shape in cross section.

7. The electronic cigarette atomizing device of claim 1, wherein the atomizer is transversally disposed in the atomizing cup, and two ends of the liquid guiding rope are respectively connected to the liquid storing portion whereby the cigarette liquid permeates into the liquid guiding rope from the liquid storing portion.

8. The electronic cigarette atomizing device of claim 7, wherein engaging holes are radially formed on and penetrate side walls of the support element for being engaged with the atomizing rod;

two ends of the atomizing rod are respectively engaged with the engaging holes so as to realize a transversal positioning of the atomizing rod;

the two ends of the liquid guiding rope pass through the support element from the engaging holes to abut against the inner walls of the liquid storing portion to absorb the cigarette liquid from the liquid storing portion;

the electric heating filament is wrapped around the atomizing rod and passes through the support element from the engaging holes along with the liquid guiding rope to reach the liquid storing portion;

the liquid storing portion is correspondingly formed with threading holes for the electric heating filament to pass through;

the two ends of the electric heating filament respectively pass through the threading holes to electrically connect the connecting module.

9. The electronic cigarette atomizing device of claim 1, wherein the atomizer is axially disposed in the atomizing cup, and two ends of the liquid guiding rope are respectively connected to the liquid storing portion whereby the cigarette liquid permeates into the liquid guiding rope from the liquid storing portion.

10. An electronic cigarette comprising a main rod body, wherein the atomizing device as claimed in claim 1 is disposed in the main rod body, a first end of the main rod body being provided with the suction nozzle, a second end thereof being installed with a battery, the atomizing device is adjacent to the suction nozzle and electrically connected with the battery.

11. The electronic cigarette of claim 10, wherein one end of the atomizing device adjacent to the battery is installed with the connecting module for electrically connecting the atomizing device and the battery, the connecting module comprises a first electrode element designated as a first electrode of the atomizing device, and a second electrode element designated as a second electrode of the atomizing device, and the first and second electrode elements are engaged with each other through an insulating ring.

12. The electronic cigarette of claim 11, wherein two ends of the electric heating filament are electrically connected to the first and second electrode elements.

13. The electronic cigarette of claim 10, further comprising a control system electrically connecting with the battery for controlling power on or off of the atomizing device, and the control system is capable of being installed between the atomizing device and the battery, or installed at one end of the battery opposite from the atomizing device.

14. An electronic cigarette device, comprises an electronic cigarette case and at least one electronic cigarette accommodated in the electronic cigarette case, wherein the at least one electronic cigarette is the electronic cigarette as claimed in claim 10.

15. The electronic cigarette atomizing device of claim 1, wherein the support element is made of materials that are high temperature-resistant and have great permeation; the cigarette liquid in the liquid storing portion is able to permeate into the support element and to be absorbed by the liquid guiding rope; and one end of the electric heating filament adjacent to the suction nozzle is bent to be securely clamped between the support element and the liquid storing element and is terminated by electrically connecting the connecting module, and another end thereof is directly electrically connected to the connecting module.

16. An electronic cigarette atomizing device, comprising an atomizing cup and an atomizer disposed in the atomizing cup, the atomizer comprising an atomizing rod and an electric heating filament wrapped around the atomizing rod, wherein the atomizing rod has a hollow tubular structure which is made of a material that is not glass fiber but high-temperature resistant and insulating material, a middle of the atomizing rod is passed through with a liquid guiding rope made of a material that is not glass fiber, and multiple liquid guiding holes are radially formed on and penetrate side walls of the atomizing rod in such a manner that a cigarette liquid of the liquid guiding rope is capable of flowing through the liquid guiding holes to the electric heating filament for being atomized and converted to smoke;

the atomizing cup comprises a liquid storing portion and a support element mounted in the liquid storing portion, the support element has a hollow tubular structure, and a middle of the hollow support element forms a communicating air channel of the atomizing device as well as an atomizing chamber for receiving the atomizer;

the liquid storing portion has a hollow tubular structure capable of absorbing and storing liquid as a sponge, and is intended to absorb and store the cigarette liquid which is then atomized by the atomizer;

the atomizing device is disposed in an inhaling rod of the electronic cigarette;

a connecting module and a suction nozzle are respectively mounted to two ends of the inhaling rod for sealing the liquid storing portion in the inhaling rod;

the atomizing rod is transversally disposed in the atomizing cup; two ends of the liquid guiding rope abut against an inner wall of the liquid storing portion so as to absorb the cigarette liquid in the liquid storing portion for the electric heating filament to heat and atomize;

a cigarette liquid cup for storing cigarette liquid is provided between the suction nozzle and the atomizing device; and a liquid guiding unit is installed between the cigarette liquid cup and the atomizing device for guiding the cigarette liquid from the cigarette liquid cup to the liquid storing portion.

17. The electronic cigarette atomizing device of claim 16, wherein an accommodating chamber is defined in an upper end of the liquid storing portion for accommodating the support element;

the support element utilizes inner walls thereof to be fitted in the liquid storing portion, and concurrently utilizes outer walls thereof to be snug against inner walls of the liquid storing portion; and the atomizer is transversally supported on the support element.

18. The electronic cigarette atomizing device of claim 16, wherein two ends of the electric heating filament respectively pass through threading holes correspondingly formed in the liquid storing portion to electrically connect the connecting module.

* * * * *